US006797677B2

(12) United States Patent
Esche, Jr. et al.

(10) Patent No.: US 6,797,677 B2
(45) Date of Patent: Sep. 28, 2004

(54) ANTIOXIDANT COMBINATION FOR OXIDATION AND DEPOSIT CONTROL IN LUBRICANTS CONTAINING MOLYBDENUM AND ALKYLATED PHENOTHIAZINE

(75) Inventors: Carl K. Esche, Jr., Richmond, VA (US); Vincent J. Gatto, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 36 days.

(21) Appl. No.: 10/158,096

(22) Filed: May 30, 2002

(65) Prior Publication Data

US 2003/0224950 A1 Dec. 4, 2003

(51) Int. Cl.[7] ..... C10M 141/12

(52) U.S. Cl. ..... 508/167; 508/170; 508/251; 508/253; 508/254; 508/362; 508/363; 508/563; 508/584

(58) Field of Search ..... 508/251, 252, 508/253, 254, 167, 170

(56) References Cited

U.S. PATENT DOCUMENTS

| | | | |
|---|---|---|---|
| 2,781,318 | A | 2/1957 | Cyphers |
| 3,038,858 | A | 6/1962 | Verley |
| 3,038,859 | A | 6/1962 | Eickemeyer et al. |
| 3,218,256 | A | 11/1965 | Edwards et al. |
| 3,255,110 | A | 6/1966 | Peeler |
| 3,344,068 | A | 9/1967 | Mold et al. |
| 3,356,702 | A | 12/1967 | Farmer et al. |
| 3,376,224 | A | 4/1968 | Elliott et al. |
| 3,476,685 | A | 11/1969 | Oberender et al. |
| 3,489,749 | A | 1/1970 | Randell |
| 3,509,051 | A | 4/1970 | Farmer et al. |
| 3,518,194 | A | 6/1970 | McGrath et al. |
| 3,523,910 | A | 8/1970 | Randell |
| 3,536,706 | A | 10/1970 | Randell |
| 3,539,515 | A | 11/1970 | McCabe |
| 3,642,630 | A | 2/1972 | MacPhail et al. |
| 3,663,437 | A | 5/1972 | Moore |
| 3,689,484 | A | 9/1972 | Spilners |
| 3,803,140 | A | 4/1974 | Cook et al. |
| 3,819,574 | A | 6/1974 | Brown et al. |
| 3,869,394 | A | 3/1975 | Daniels et al. |
| 3,882,044 | A | 5/1975 | McGuigan et al. |
| 3,909,448 | A | 9/1975 | McGuigan et al. |
| 3,925,215 | A | 12/1975 | Jervis et al. |
| 3,956,289 | A | 5/1976 | McGuigan et al. |
| 4,072,619 | A | 2/1978 | Williams et al. |
| 4,089,794 | A | 5/1978 | Engel et al. |
| 4,098,705 | A | 7/1978 | Sakurai et al. |
| 4,137,185 | A | 1/1979 | Gardiner et al. |
| 4,144,181 | A | 3/1979 | Elliott et al. |
| 4,146,489 | A | 3/1979 | Stambaugh et al. |
| 4,164,473 | A | 8/1979 | Coupland et al. |
| 4,178,258 | A | 12/1979 | Papay et al. |
| 4,248,725 | A | 2/1981 | Crawford et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,266,945 | A | 5/1981 | Karn |
| 4,272,387 | A | 6/1981 | King |
| 4,283,295 | A | 8/1981 | deVries et al. |
| 4,285,822 | A | 8/1981 | deVries et al. |
| 4,320,019 | A | 3/1982 | Hayashi |
| 4,340,689 | A | 7/1982 | Joffrion |
| 4,354,950 | A | 10/1982 | Hammond et al. |
| 4,357,250 | A | 11/1982 | Hayashi |
| 4,362,633 | A | 12/1982 | Spence et al. |
| 4,369,119 | A | 1/1983 | deVries et al. |
| 4,382,007 | A | 5/1983 | Chafetz et al. |
| 4,395,343 | A | 7/1983 | deVries et al. |
| 4,402,840 | A | 9/1983 | deVries et al. |
| 4,466,901 | A | 8/1984 | Hunt et al. |
| 4,482,464 | A | 11/1984 | Karol et al. |
| 4,522,736 | A | 6/1985 | Andress et al. |
| 4,596,663 | A | 6/1986 | Hayashi |
| 4,627,929 | A | 12/1986 | Buysch et al. |
| 4,636,322 | A | 1/1987 | Nalesnik |
| 4,652,387 | A | 3/1987 | Andress, Jr. et al. |
| 4,664,822 | A | 5/1987 | Hunt et al. |
| 4,692,256 | A | 9/1987 | Umemura et al. |
| 4,693,838 | A | 9/1987 | Varma et al. |
| 4,698,169 | A | 10/1987 | Andress, Jr. et al. |
| 4,699,724 | A | 10/1987 | Nalesnik et al. |
| 4,713,189 | A | 12/1987 | Nalesnik et al. |
| 4,713,489 | A | 12/1987 | Birum et al. |
| 4,765,918 | A | 8/1988 | Love et al. |
| 4,767,551 | A | 8/1988 | Hunt et al. |
| 4,803,004 | A | 2/1989 | Andress et al. |
| 4,828,742 | A | 5/1989 | Lundberg et al. |
| 4,863,623 | A | 9/1989 | Nalesnik |

(List continued on next page.)

FOREIGN PATENT DOCUMENTS

| | | |
|---|---|---|
| EP | 1 136 496 A1 | 9/2001 |
| EP | 1 136 497 A1 | 9/2001 |

*Primary Examiner*—Ellen M. McAvoy
(74) *Attorney, Agent, or Firm*—Dennis H. Rainear; Leah Oubre Robinson

(57) ABSTRACT

The invention relates to a lubricating oil composition having improved antioxidant properties, and which contains a molybdenum compound and an alkylated phenothiazine. Further, it may also include a secondary diarylamine, preferably an alkylated diphenylamine. This combination of additives provides improved oxidation control and friction modifier performance to the lubricating oil. The composition is particularly suited for use as a crankcase lubricant, or a transmission lubricant, including low levels and zero levels of phosphorus.

88 Claims, No Drawings

U.S. PATENT DOCUMENTS 4,889,647 A 12/1989 Rowan et al.
4,966,719 A 10/1990 Coyle et al.
4,978,464 A 12/1990 Coyle et al.
4,990,271 A 2/1991 Francis
4,995,996 A 2/1991 Coyle et al.
5,026,495 A 6/1991 Emert et al.
5,030,369 A 7/1991 Emert et al.
5,034,019 A 7/1991 Salomon
5,035,817 A 7/1991 Salomon
5,043,084 A 8/1991 Gutierrez et al.
5,073,278 A 12/1991 Schumacher et al.
5,075,383 A 12/1991 Migdal et al.
5,085,788 A 2/1992 Emert et al.
5,102,566 A 4/1992 Fetterman, Jr. et al.
5,102,570 A 4/1992 Migdal et al.
5,112,508 A 5/1992 DeRosa et al.
5,137,647 A 8/1992 Karol
5,139,688 A 8/1992 Nalesnik
5,157,118 A 10/1992 Salomon
5,158,690 A 10/1992 Batchelder et al.
5,167,844 A 12/1992 Schumacher
5,178,783 A 1/1993 Salomon
5,178,784 A 1/1993 Salomon
5,182,041 A 1/1993 Benfarmeo et al.
5,200,100 A 4/1993 Kapuscinski et al.
5,238,588 A 8/1993 Nalesnik et al.
5,273,669 A * 12/1993 Schumacher et al. ..... 508/251
5,277,833 A 1/1994 Song et al.
5,412,130 A 5/1995 Karol
5,503,759 A 4/1996 Evans et al.
5,614,124 A 3/1997 Esche, Jr. et al.
5,616,153 A 4/1997 Mike et al.
5,731,273 A * 3/1998 Field ..... 508/251
5,942,471 A * 8/1999 Kapuscinski et al. ..... 508/251
6,103,674 A 8/2000 Nalesnik et al.
6,117,826 A 9/2000 Baranski et al.
6,153,564 A * 11/2000 Arunasalam et al. ..... 508/363
6,174,842 B1 1/2001 Gatto et al.
6,232,276 B1 5/2001 Stiefel et al.
6,358,894 B1 * 3/2002 Leta et al. ..... 508/363
6,599,865 B1 * 7/2003 Esche et al. ..... 508/254

* cited by examiner

ANTIOXIDANT COMBINATION FOR OXIDATION AND DEPOSIT CONTROL IN LUBRICANTS CONTAINING MOLYBDENUM AND ALKYLATED PHENOTHIAZINE

BACKGROUND OF THE INVENTION

1. Field of the Invention

This invention relates to lubricating oil compositions, their method of preparation, and use. More specifically, this invention relates to lubricating oil compositions which contain a molybdenum compound and an alkylated phenothiazine. The composition may further contain a secondary diarylamine. The use of both the molybdenum and the alkylated phenothiazine, and alternatively further with the secondary diarylamine, provides improved oxidation and deposit control to lubricating oil compositions. The lubricating oil compositions of this invention are particularly useful as crankcase and transmission lubricants.

2. Description of the Related Art

Lubricating oils as used in the internal combustion engines and transmissions of automobiles or trucks are subjected to a demanding environment during use. This environment results in the oil suffering oxidation which is catalyzed by the presence of impurities in the oil such as iron compounds and is also promoted by the elevated temperatures of the oil during use.

The oxidation of lubrication oils during use is usually controlled to some extent by the use of antioxidant additives which may extend the useful life of the lubricating oil, particularly by reducing or preventing unacceptable viscosity increases. Aminic antioxidants are antioxidants that contain one or more nitrogen atoms. An example of an aminic antioxidant is phenothiazine. The prior art discloses the many teachings on the synthesis and uses of phenothiazine. Phenothiazine antioxidants have been used as a stand alone additive, chemically modified or grafted onto the backbone of polymers.

Lubricant compositions containing various molybdenum compounds and aromatic amines have been used in lubricating oils. Such compositions include active sulfur or phosphorous as part of the molybdenum compound, use additional metallic additives, various amine additives which are different from those used in this invention, and/or have concentrations of molybdenum and amine which do not show the synergistic results obtained by this invention.

An interesting trend in the lubricant industry is a shift to lower and lower phosphorus levels. Thus, at some point the industry will require lubricant formulations for crankcase and transmission fluids, both automatic and manual, with zero or essentially zero phosphorus content.

Existing lubricants employing phenothiazine are taught in U.S. Pat. No. 5,614,124 and references cited therein, all of which are incorporated herein in their entirety by reference.

SUMMARY OF THE INVENTION

This invention relates to lubricating oil compositions, their method of preparation, and use. More specifically, this invention relates to lubricating oil compositions which contain a molybdenum compound and an alkylated phenothiazine. The composition may further contain a secondary diarylamine. The use of both the molybdenum and the alkylated phenothiazine, and alternatively further with the secondary diarylamine, provides improved oxidation and deposit control to lubricating oil compositions. The lubricating oil compositions of this invention are particularly useful as crankcase and transmission lubricants.

DETAILED DESCRIPTION OF THE INVENTION

It has been found that the combination of (1) an oil soluble molybdenum compound and (2) an alkylated phenothiazine, and also preferably a secondary diarylamine, such as an alkylated diphenylamine, is highly effective at controlling crankcase lubricant oxidation and deposit formation. Examples of the types of compounds that may be used in this invention are described in the following. The alkylated diphenylamine (preferred secondary diarylamine) may be used at concentrations ranging from 0.1 to 2.5 wt. % in the finished lubricant, preferably between 0.2 to 1.5 wt. %. The molybdenum compound may be used between 20 and 1000 ppm, preferably between 20 to 200 ppm, based on the amount of molybdenum delivered to the finished lubricating oil. The alkylated phenothiazine may be used at concentrations ranging from 0.05 to 1.5 wt. % in the finished lubricant, preferably between 0.1 to 1.0 wt. %. In addition to the antioxidants of this invention, the lubricating composition may also contain dispersants, detergents, anti-wear additives including for example ZDDP, additional antioxidants if required, friction modifiers, corrosion inhibitors, anti-foaming additives, pour point depressants and viscosity index improvers. The lubricant may be prepared from any paraffinic, naphthenic, aromatic, or synthetic base oil, or mixtures thereof. In an embodiment, the lubricant may contain between 250 and 1000 ppm of phosphorus derived from ZDDP and between 500 and 3000 ppm of calcium from calcium containing sulfonate detergents or calcium containing phenate detergents. In this manner, both crankcase and automatic transmission fluid (ATF) lubricants are readily prepared.

Thus, in an embodiment of the present invention is provided crankcase and transmission fluid lubricants and additive package concentrates therefor, which contain very low levels of phosphorus. More preferred, are lubricant compositions containing zero or essentially zero phosphorus. By "essentially zero phosphorus" herein is meant phosphorus levels of less than or equal to about 100 ppm.

In another embodiment, the lubricant does not contain ZDDP, but may contain other sources of phosphorus.

I. Molybdenum Compounds

1. Sulfur- and Phosphorus-Free Organomolybdenum Compound

A sulfur- and phosphorus-free organomolybdenum compound that is a component of the present invention may be prepared by reacting a sulfur and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be monosubstituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds appearing in patents and patent applications which are fully incorporated herein by reference include the following:

1. Compounds prepared by reacting certain basic nitrogen compounds with a molybdenum source as defined in U.S. Pat. Nos. 4,259,195 and 4,261,843.

2. Compounds prepared by reacting a hydrocarbyl substituted hydroxy alkylated amine with a molybdenum source as defined in U.S. Pat. No. 4,164,473.
3. Compounds prepared by reacting a phenol aldehyde condensation product, a mono-alkylated alkylene diamine, and a molybdenum source as defined in U.S. Pat. No. 4,266,945.
4. Compounds prepared by reacting a fatty oil, diethanolamine, and a molybdenum source as defined in U.S. Pat. No. 4,889,647.
5. Compounds prepared by reacting a fatty oil or acid with 2-(2-aminoethyl)aminoethanol, and a molybdenum source as defined in U.S. Pat. No. 5,137,647.
6. Compounds prepared by reacting a secondary amine with a molybdenum source as defined in U.S. Pat. No. 4,692,256.
7. Compounds prepared by reacting a diol, diamino, or amino-alcohol compound with a molybdenum source as defined in U.S. Pat. No. 5,412,130.
8. Compounds prepared by reacting a fatty oil, mono-alkylated alkylene diamine, and a molybdenum source as defined in European Patent Application EP 1 136 496 A1.
9. Compounds prepared by reacting a fatty acid, mono-alkylated alkylene diamine, glycerides, and a molybdenum source as defined in European Patent Application EP 1 136 497 A1.

Examples of commercial sulfur- and phosphorus-free oil soluble molybdenum compounds are Sakura-Lube 700 from Asahi Denka Kogyo K. K., and Molyvan® 856B and Molyvan® 855 from R. T. Vanderbilt Company, Inc.

Molybdenum compounds prepared by reacting a fatty oil, diethanolamine, and a molybdenum source as defined in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

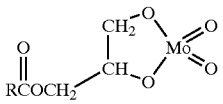

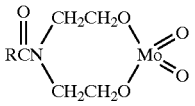

II. Sulfur-Containing Organomolybdenum Compound

The sulfur-containing organomolybdenum compound useful in the present invention may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}{*}n(H_2O)$ where n varies between 0 to 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as defined in U.S. Pat. Nos. 3,509,051 and 3,356,702.
2. Compounds prepared by reacting a sulfur-free molybdenum source with a secondary amine, carbon disulfide, and an additional sulfur source as defined in U.S. Pat. No. 4,098,705.
3. Compounds prepared by reacting a molybdenum halide with a secondary amine and carbon disulfide as defined in U.S. Pat. No. 4,178,258.
4. Compounds prepared by reacting a molybdenum source with a basic nitrogen compound and a sulfur source as defined in U.S. Pat. Nos. 4,263,152, 4,265,773, 4,272,387, 4,285,822, 4,369,119, 4,395,343.
5. Compounds prepared by reacting ammonium tetrathiomolybdate with a basic nitrogen compound as defined in U.S. Pat. No. 4,283,295.
6. Compounds prepared by reacting an olefin, sulfur, an amine and a molybdenum source as defined in U.S. Pat. No. 4,362,633.
7. Compounds prepared by reacting ammonium tetrathiomolybdate with a basic nitrogen compound and an organic sulfur source as defined in U.S. Pat. No. 4,402,840.
8. Compounds prepared by reacting a phenolic compound, an amine and a molybdenum source with a sulfur source as defined in U.S. Pat. No. 4,466,901.
9. Compounds prepared by reacting a triglyceride, a basic nitrogen compound, a molybdenum source, and a sulfur source as defined in U.S. Pat. No. 4,765,918.
10. Compounds prepared by reacting alkali metal alkylthioxanthate salts with molybdenum halides as defined in U.S. Pat. No. 4,966,719.
11. Compounds prepared by reacting a tetralkylthiuram disulfide with molybdenum hexacarbonyl as defined in U.S. Pat. No. 4,978,464.
12. Compounds prepared by reacting an alkyl dixanthogen with molybdenum hexacarbonyl as defined in U.S. Pat. No. 4,990,271.
13. Compounds prepared by reacting alkali metal alkylxanthate salts with dimolybdenum tetra-acetate as defined in U.S. Pat. No. 4,995,996.
14. Compounds prepared by reacting $(NH_4)_2Mo_3S_{13*2}H_2O$ with an alkali metal dialkyldithiocarbamate or tetralkyl thiuram disulfide as define in U.S. Pat. No. 6,232,276.
15. Compounds prepared by reacting an ester or acid with a diamine, a molybdenum source and carbon disulfide as defined in U.S. Pat. No. 6,103,674.
16. Compounds prepared by reacting an alkali metal dialkyldithiocarbamate with 3-chloropropionic acid, followed by molybdenum trioxide, as defined in U.S. Pat. No. 6,117,826.

Examples of commercial sulfur-containing oil soluble molybdenum compounds are Sakura-Lube 100, Sakura-Lube 155, Sakura-Lube 165, and Sakura-Lube 180 from Asahi Denka Kogyo K. K., Molyvan® A, Molyvan® 807 and Molyvan® 822 from R. T. Vanderbilt Company, and Naugalube MolyFM from Crompton Corporation.

Molybdenum dithiocarbamates are illustrated with the following structure, where R is an alkyl group containing 4 to 18 carbons or H, and X is O or S.

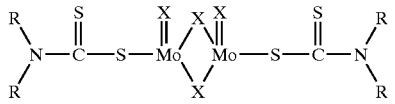

II. Alkylated Phenothiazine

An alkylated phenothiazine suitable for this invention must be oil soluble or dispersible and correspond to the general formula below wherein $R_1$ is a linear or branched $C_4$–$C_{24}$ alkyl, heteroalkyl or alkylaryl group and $R_2$ is H or a linear or branched $C_4$–$C_{24}$ alkyl, heteroalkyl or alkylaryl group.

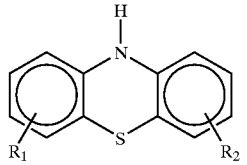

Typical examples of alkylphenothiazine include but are not limited to monotetradecylphenothiazine, ditetradecylphenothiazine, monodecylphenothiazine, didecylphenothiazine monononylphenothiazine, dinonylphenothiazine, monoctylphenothiazine and dioctylphenothiazine.

General Preparation of an Alkylphenothiazine

Non-limiting examples of the preparation of alkylphenothiazine are mentioned in U.S. Pat. Nos. 5,614,124 and 2,781,318.

Diphenylamine can be alkylated with an olefin in the presence of a catalyst. Typical catalysts are acid clay or $AlCl_3$. The alkyldiphenylamine can then be sulfurized in the presence of a sulfurizing agent and a catalyst. The preferred sulfur reagent and catalyst are elemental sulfur and iodine, respectively. Non-limiting other sulfurization catalysts are aluminum bromide, aluminum chloride, copper iodide, sulfur iodide, antimony chloride or Iron (III) chloride.

Thus, the alkyldiphenylamine can be of any structure so long as it contains at least one nitrogen atom, two aromatic rings such that each aromatic ring has at least one open ortho position to effect sulfurization and be oil soluble. A partial list of non-limiting alkyldiphenylamines suitable for sulfurization includes: monoctyldiphenylamine, dioctyldiphenylamine, mononononyldiphenylamine, dinonyldiphenylamine, monodecyldiphenylamine, didecyldiphenylamine, monotetradecyldiphenylamine, ditetradecyldiphenylamine as well as various mixtures and combinations of these alkyldiphenylamines. Names of commercial alkyldiphenylamines suitable for use with this invention are Naugalube N-438L, manufactured by CK Witco, and Goodrite 3190NT, manufactured by Noveon.

EXAMPLE 1

$C_{14}$ Alkylphenothiazine Synthesis

Into a round bottom flask equipped with a stirrer, reflux condenser, thermometer, thermocouple and nitrogen gas inlet tube are added the following: $C_{14}$ alkyldiphenylamine (374 gms, 0.680 mols), elemental sulfur (65 gms, 2.04 mols), iodine (5.7 gms, 0.022 mols) and xylenes (344 ml). Nitrogen gas was bubbled into the reaction mixture at 200 ml/min and with vigorous agitation the reaction mixture was cooked at 140° C. for 4 hours. The product was stripped of solvent and iodine to yield 396 gms of product. Found analytical data: wt. %N=2.9, wt. %S=7.89 and 100° C. KV=31.43.

EXAMPLE 2

Mixed Mono and Di-$C_9$ Alkylphenothiazine Synthesis

Into a round bottom flask equipped with a stirrer, reflux condenser, thermometer, thermocouple and nitrogen gas inlet tube are added the following: $C_9$ alkyldiphenylamine (264.9 gms, 0.680 mols), elemental sulfur (65 gms, 2.04 mols), iodine (5.7 gms, 0.022 mols), base oil (286.7 gms) and xylenes (344 ml). Nitrogen gas was bubbled into the reaction mixture at 200 ml/min and with vigorous agitation the reaction mixture was cooked at 140° C. for 4 hours. The product was stripped of solvent and iodine to yield 533 gms of product. Found analytical data: wt. %N=1.56, wt. %S=5.45, and 100° C. KV=30.0.

III. Alkylated Diarylamine

The diarylamines that may optionally be used, and that have been found to be useful in this invention are well known antioxidants and there is no known restriction on the type of diarylamine that can be used. Preferably, the diarylamine has the formula:

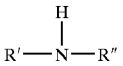

wherein R' and R" each independently represents a substituted or unsubstituted aryl group having from 6 to 30 carbon atoms. Illustrative of substituents for the aryl group include aliphatic hydrocarbon groups such as alkyls having from 1 to 30 carbon atoms, hydroxy groups, halogen radicals, carboxylic acid or ester groups, or nitro groups. The aryl is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. monoalkylated diphenylamine, di-alkylated diphenylamine, or mixtures of mono- and di-alkylated diphenylamines.

The diarylamines used in this invention can be of a structure other than that shown in the above formula that shows but one nitrogen atom in the molecule. Thus the diarylamine can be of a different structure provided that at least one nitrogen has 2 aryl groups attached thereto, e.g. as in the case of various diamines having a secondary nitrogen atom as well as two aryl groups bonded to one of the nitrogen atoms.

The diarylamines used in this invention should be soluble in the formulated crankcase oil package. Examples of some diarylamines that may be used in this invention include: diphenylamine; various alkylated diphenylamines; 3-hydroxydiphenylamine; N-phenyl-1,2-phenylenediamine; N-phenyl-1,4-phenylenediamine; monobutyldiphenylamine; dibutyldiphenylamine; monooctyldiphenylamine; dioctyldiphenylamine; mononononyldiphenylamine; dinonyldiphenylamine; monotetradecyldiphenylamine; ditetradecyldiphenylamine; phenyl-alpha-naphthylamine; monooctyl phenyl-alpha-naphthylamine; phenyl-beta-naphthylamine; monoheptyldiphenylamine; diheptyldiphenylamine;

p-oriented styrenated diphenylamine; mixed butyloctyldiphenylamine; and mixed octylstryryldiphenylamine, and mixtures thereof. Examples of commercial diarylamines include, for example, Irganox L06, Irganox L57 and Irganox L67 from Ciba Specialty Chemicals; Naugalube AMS, Naugalube 438, Naugalube 438R, Naugalube 438L, Naugalube 500, Naugalube 640, Naugalube 680, and Naugard PANA from Crompton Corporation; Goodrite 3123, Goodrite 3190X36, Goodrite 3127, Goodrite 3128, Goodrite 3185X1, Goodrite 3190X29, Goodrite 3190X40, Goodrite 3191 and Goodrite 3192 from Noveon Specialty Chemicals; Vanlube DND, Vanlube NA, Vanlube PNA, Vanlube SL, Vanlube SLHP, Vanlube SS, Vanlube 81, Vanlube 848, and Vanlube 849 from R. T. Vanderbilt Company Inc.

IV. Evaluation of Passenger Car Engine Oils in the Micro-Oxidation Test

Preparation of Additized Test Oils

Passenger car engine oils were blended as described in Table 1. The preblend used was a 5W- 30 passenger car engine oil formulated in Group II basestock containing 500 ppm of phosphorus derived from ZDDP, detergents, dispersants, pour point depressants and viscosity index improvers but no supplemental ashless antioxidants. The alkylated diphenylamine used was HiTEC® 4793 additive, a styryl octyl alkylated diphenylamine available from Ethyl Corporation. The tetradecyl diphenylamine used was obtained from the R. T. Vanderbilt Company. Molybdenum compound M-1 was HiTEC® 4716 additive, an organomolybdenum complex available from Ethyl Corporation containing approximately 8.0 wt. % molybdenum. Molybdenum compound M-2 was Sakura-lube 165, a molybdenum dithiocarbamate available from Asahi Denka Kogyo K. K. containing approximately 4.5 wt. % molybdenum. Molybdenum compound M-3 was an experimental organomolybdenum complex prepared at Ethyl Corporation containing approximately 8.2 wt. % molybdenum. Molybdenum compound M-4 was an experimental organomolybdenum complex prepared at Ethyl Corporation containing approximately 8.3 wt. % molybdenum. The calcium phenate used was LZ-6499 available from Lubrizol Corporation and contained approximately 8.9 wt. % calcium, 3.3 wt. % sulfur, and had a total base number (TBN) of 247 mg KOH/g. The tetradecylphenothiazine used was an experimental product prepared from the tetradecyldiphenylamine at Ethyl Corporation and contained approximately 8.1 wt. % sulfur and 2.7 wt. % nitrogen. The process oil used was a 100N paraffinic process oil. The components were blended into the preblend at 50° C. for approximately 3 hours and cooled.

Evaluation of Additized Test Oils for Deposit Control

The Micro-Oxidation Test is a commonly used technique for evaluating the deposit forming tendencies of a wide variety of passenger car and diesel lubricants as well as mineral and synthetic basestocks. The test measures the oxidative stability and deposit forming tendencies of lubricants under high temperature thin-film oxidation conditions. The ability to easily vary test conditions and the flexibility of presenting test results makes it a valuable research tool for screening a wide variety of lubricant products.

In this test, a thin-film of finished oil is accurately weighed onto an indented low carbon steel sample holder sitting in a glass impinger tube. The sample, coupon and impinger tube assembly is then immersed in a high temperature bath. Dry air is passed, at a specific rate, through the impinger tube, over the oil sample, and out of the impinger tube to the atmosphere. At specific time intervals the carbon steel sample holders are removed from the high temperature bath, rinsed with solvent to remove any remaining oil, and oven dried. The solvent washes are filtered to collect any deposits that dislodge from the carbon steel holders. The sample holders and collected deposits are weighed to determine the amount of deposit formed at the sampling interval. Results are reported as the percent of oil forming deposit at a specific time interval. The induction time to deposit formation can also be determined by calculating the intercept between the baseline formed where minimal deposits are seen, and the slope formed where a rapid rise in deposit formation is seen. Longer induction times correspond to improved deposit control. Another parameter of value in this test is the Performance Index (PI). The performance index represents the reduction in deposit formation of the additized finished oil over the entire sampling range of testing versus the baseline finished oil over the same sampling range. The formula for calculating PI is as follows:

$$PI=[((\text{area of baseline oil}/\text{area of additized oil})-1)\times 100]$$

A larger Performance Index (PI) corresponds to improved deposit control.

The test conditions used to evaluated the additized test oils were as follows: gas=dry air, flow=20 cc/minute, temperature=230° C., sampling interval=50, 60, 70, 80, 90, 100, 110, 120 minutes, sample size=approximately 20 microL accurately weighed.

The deposit control results are shown in the attached Table 1. The results show consistently that with all molybdenum additive types, the combination of molybdenum and alkylated phenothiazine (Oils 8, 9, 10, and 11) is effective at improving deposit control relative to oils not containing both molybdenum and alkylated phenothiazine. Oils containing only molybdenum (Oils 2, 3 and 4), or only alkylated phenothiazine (Oil 5), or only tetradecyldiphenylamine (Oil 6), are less effective at controlling deposits. The oil containing molybdenum and tetradecyldiphenylamine (Oil 7) is also less effective at controlling deposits, indicating that the tetradecylphenothiazine/molybdenum combination is unique for controlling deposits. Oil 12 is an example of the deposit control technology disclosed in U.S. Pat. No. 6,174,842. Note that the inventive combination of molybdenum compound M-3 and alkylated phenothiazine affords improved deposit control over the results from Oil 12 obtained from the technology disclosed in U.S. Pat. No. 6,174,842.

Evaluation of Passenger Car Engine Oils in the Thermo-Oxidation Engine Oil Simulation Test (TEOST MHT-4)

The TEOST MHT-4 is a standard lubricant industry test for the evaluation of the oxidation and carbonaceous deposit-forming characteristics of engine oils. The test is designed to simulate high temperature deposit formation in the piston ring belt area of modern engines. The test utilizes a patented instrument (U.S. Pat. No. 5,401,661 and U.S. Pat. No. 5,287,731) with the MHT-4 protocol being a relatively new modification to the test. Details of the test operation and specific MHT-4 conditions have been published by Selby and Florkowski in a paper entitled, "The Development of the TEOST Protocol MHT as a Bench Test of Engine Oil Piston Deposit Tendency," presented a the $12^{th}$ International Colloquium Technische Akademie Esslingen, Jan. 11–13, 2000, Wilfried J. Bartz editor.

Oils #4 through $10 and #12 were evaluated in the TEOST MHT-4 with the results shown in the attached Table 1. Note that oils containing tetradecylphenothiazine and molybdenum (Oils #8, 9, and 10) showed improved deposit control versus the corresponding molybdenum compound alone (Oil #4), tetradecylphenothiazine alone (Oil #5), tetradecyldiphenylamine alone (Oil #6), and a combination of tetradecyldiphenylamine and molybdenum (Oil #7).

Evaluation of Passenger Car Engine Oils in the Hot Oil Oxidation Test

Oils #1, #5 and #10 were evaluated for oxidative stability in the Hot Oil Oxidation Test. In this test 25.0 grams of the test oil is treated with an iron(III)naphthenate catalyst to deliver approximately 250 ppm oil soluble iron to the test oil. The test oil is oxidized in a test tube by bubbling dry air through the oil at a specific rate (10 L/hour) and temperature (160° C.) and for a specific time period. At various time intervals (24, 32, 48, 56, 72, 80 hours) the oxidized oil is removed from the test apparatus and analyzed for viscosity at 40° C. The percent viscosity increase (PVI) of the oxidized oil (Ox) versus the fresh oil without catalyst (Fresh) is determined using the following formula: PVI @ 40° C.=((40° C. viscosity Ox−40° C. viscosity Fresh)/(40° C. viscosity Fresh))×100.

An increase in PVI corresponds to an increase in the rate of oil oxidation. The Hot Oil Oxidation Test results are shown in Table 2. Note that the combination of alkylated phenothiazine and molybdenum in oil #10 affords excellent oxidation control versus the lower performance of oil with only alkylated phenothiazine (#5) or the oil with no alkylated phenothiazine and no molybdenum (#1).

TABLE 2

Evaluation Of Crankcase Lubricants in the Hot Oil Oxidation Test

| Time (min) | Oil #1 | Oil #5 | Oil #10 |
|---|---|---|---|
| 24 h % visc inc | −27.8 | −30.6 | −28.8 |

TABLE 2-continued

Evaluation Of Crankcase Lubricants in the Hot Oil Oxidation Test

| Time (min) | Oil #1 | Oil #5 | Oil #10 |
|---|---|---|---|
| 32 h % visc inc | −13.2 | −30.1 | −28.2 |
| 48 h % visc inc | 56.3 | −29.4 | −28.0 |
| 56 h % visc inc | | −21.0 | −25.5 |
| 72 h % visc inc | 1886.3 | 34.9 | −23.6 |
| 80 h % visc inc | TVTM | 82.3 | −22.8 |

TVTM-Too viscous to measure

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

Also, numerous patents have been identified herein. Those patents are incorporated herein by reference as if set forth in their entirety.

The patentee does not intend to dedicate any disclosed embodiments to the public, and to the extend any disclosed modifications or alterations may not literally fall within the scope of the claims, they are considered to be part of the invention under the doctrine of equivalents.

TABLE 1

Evaluation Of Crankcase Lubricants For Deposit Control

| Oil Number | | Oil #1 | Oil #2 | Oil #3 | Oil #4 | Oil #5 | Oil #6 | Oil #7 | Oil #8 | Oil #9 | Oil #10 | Oil #11 | Oil #12* |
|---|---|---|---|---|---|---|---|---|---|---|---|---|---|
| Crankcase Oil Composition | | | | | | | | | | | | | |
| Preblend | wt. % | 97.30 | 97.30 | 97.30 | 97.30 | 97.30 | 97.30 | 97.30 | 97.30 | 97.30 | 97.30 | 97.30 | 97.30 |
| Alkylated diphenylamine | wt. % | 0.70 | 0.70 | 0.70 | 0.70 | 0.70 | 0.70 | 0.70 | 0.70 | 0.70 | 0.70 | 0.70 | 0.70 |
| Tetradecyl diphenylamine | wt. % | | | | | | 0.40 | 0.40 | | | | | |
| Molybdenum content | ppm | | 160 | 160 | 160 | | | 160 | 160 | 160 | 160 | 160 | 160 |
| Molybdenum content | wt. % | | 0.20 | 0.36 | 0.20 | | | 0.20 | 0.20 | 0.36 | 0.20 | 0.20 | 0.20 |
| Molybdenum Type | | | M-1 | M-2 | M-3 | None | None | M-3 | M-1 | M-2 | M-3 | M-4 | M-3 |
| Tetradecylphenothiazine | wt. % | | | | | 0.40 | | | 0.40 | 0.40 | 0.40 | 0.40 | |
| Calcium Phenate | wt. % | | | | | | | | | | | | 0.40 |
| Process Oil | wt. % | 2.00 | 1.80 | 1.64 | 1.80 | 1.60 | 1.60 | 1.40 | 1.40 | 1.24 | 1.40 | 1.40 | 1.40 |
| TEOST MHT-4 Results | | | | | | | | | | | | | |
| Total Deposits | mg | | | | 62.2 | 41.1 | 60.2 | 40.1 | 39.9 | 31.9 | 31.2 | | 58.1 |
| CMOT Results | | | | | | | | | | | | | |
| Percent Deposits | | | | | | | | | | | | | |
| 50 min | wt. % | 10.28 | 6.25 | 6.31 | 12.40 | 5.95 | 8.08 | 9.06 | 1.54 | 2.28 | 1.26 | 2.72 | 2.28 |
| 60 min | wt. % | 11.07 | 6.33 | 6.59 | 12.42 | 5.98 | 11.70 | 9.09 | 5.79 | 3.00 | 1.28 | 3.38 | 2.38 |
| 70 min | wt. % | 17.20 | 6.89 | 12.11 | 12.45 | 12.11 | 16.52 | 15.75 | 5.82 | 4.14 | 2.18 | 3.61 | 3.20 |
| 80 min | wt. % | 19.12 | 19.95 | 14.55 | 21.14 | 14.51 | 21.80 | 17.07 | 4.76 | 9.78 | 2.18 | 3.99 | 8.40 |
| 90 min | wt. % | 22.67 | 22.75 | 16.46 | 24.01 | 15.65 | 24.30 | 21.45 | 18.05 | 11.21 | 6.76 | 7.82 | 14.68 |
| 100 min | wt. % | 26.77 | 27.16 | 19.12 | 23.98 | 18.33 | 29.43 | 23.53 | 18.84 | 14.09 | 8.74 | 11.66 | 16.93 |
| 110 min | wt. % | 29.26 | 27.98 | 28.29 | 24.09 | 31.95 | 36.27 | 28.60 | 20.56 | 22.41 | 8.74 | 11.77 | 18.64 |
| 120 min | wt. % | 32.66 | 25.09 | 28.13 | 24.07 | 30.00 | 34.10 | 24.62 | 23.77 | 21.15 | 8.54 | 11.97 | 26.64 |
| Onset To Deposit Formation | | | | | | | | | | | | | |
| | min | 55 | 70 | 59 | 68 | 61 | <50 | 57 | 78 | 70 | 79 | 80 | 68 |
| Performance Index [((area No Mo/area plus Mo) − 1) × 100] | | | | | | | | | | | | | |
| PI | | 0 | 19 | 28 | 9 | 26 | −7 | 13 | 71 | 92 | 326 | 197 | 81 |

TABLE 1-continued

Evaluation Of Crankcase Lubricants For Deposit Control

| Oil Number | Oil #1 | Oil #2 | Oil #3 | Oil #4 | Oil #5 | Oil #6 | Oil #7 | Oil #8 | Oil #9 | Oil #10 | Oil #11 | Oil #12* |
|---|---|---|---|---|---|---|---|---|---|---|---|---|

M-1 - HiTEC 4716 organomolybdenum complex from Ethyl Corporation (8.0 wt. % Mo)
M-2 - Sakura-Lube 165 molybdenum dithiocarbamate from Asahi Denka Kogyo K. K. (4.5 wt. % Mo)
M-3 - X-10826LC Experimental Organomolybdenum from Ethyl Corporation (8.2 wt. % Mo)
M-4 - X-10826LC Experimental Organomolybdenum from Ethyl Corporation (8.3 wt. % Mo)
Alkylated Diphenylamine - HiTEC 7190 from Ethyl Corporation
Calcium Phenate - LZ-6499 From Lubrizol Corporation
Tetradecylphenothiazine - Reaction product of tetradecyl diphenylamine and elemental sulfur
Tetradecyl Diphenylamine - Obtained from R.T. Vanderbilt Chemical Company
* - Indicates deposit control technology disclosed in U.S. Pat. No. 6,174,842

What is claimed is:

1. A lubricating composition consisting essentially of a major amount of lubricating oil, and minor amounts of an oil soluble secondary diarylamine, an oil soluble molybdenum compound, and an oil soluble $C_{4-24}$ alkylated phenothiazine, wherein said molybdenum compound is selected from the group consisting of molybdenum trioxides, ammonium molybdates, sodium molybdates, potassium molybdates, molybdenum dithiocarbamates, compounds prepared by reacting molybdenum trioxide with a secondary amine and carbon disulfide, compounds prepared by reacting a sulfur-free molybdenum source with a secondary amine, carbon disulfide, and an additional sulfur source, compounds prepared by reacting a molybdenum halide with a secondary amine and carbon disulfide, compounds prepared by reacting a molybdenum source with a basic nitrogen compound and a sulfur source, compounds prepared by reacting ammonium tetrathiomolybdate with a basic nitrogen compound, compounds prepared by reacting an olefin, sulfur, an amine and a molybdenum source, compounds prepared by reacting ammonium tetrathiomolybdate with a basic nitrogen compound and an organic sulfur source, compounds prepared by reacting a phenolic compound, an amine and a molybdenum source with a sulfur source, compounds prepared by reacting a triglyceride, a basic nitrogen compound, a molybdenum source, and a sulfur source, compounds prepared by reacting alkali metal alkylthioxanthate salts with molybdenum halides, compounds prepared by reacting a tetralkylthiuram disulfide with molybdenum hexacarbonyl, compounds prepared by reacting an alkyl dixanthogen with molybdenum hexacarbonyl, compounds prepared by reacting alkali metal alkylxanthate salts with dimolybdenum tetra-acetate, compounds prepared by reacting $(NH_4)_2Mo_3S_{13}{}^*{}_2H_2O$ with an alkali metal dialkyldithiocarbarnate or tetraalkyl thiuram disulfide, compounds prepared by reacting an ester or acid with a diamine, a molybdenum source and carbon disulfide, compounds prepared by reacting an alkali metal dialkyldithiocarbarnate with 3-chloropropionic acid, followed by molybdenum trioxide, compounds prepared by reacting basic nitrogen compounds with a molybdenum source, compounds prepared by reacting a hydrocarbyl substituted hydroxy alkylated amine with a molybdenum source, compounds prepared by reacting a phenol aldehyde condensation product, a mono-alkylated alkylene diamine, and a molybdenum source, compounds prepared by reacting a fatty oil, diethanolanilne, and a molybdenum source, compounds prepared by reacting a fatty oil or acid with 2-(2-aminoethyl)aminoethanol, and a molybdenum source, compounds prepared by reacting a secondary amine with a molybdenum source, compounds prepared by reacting a diol, diamino, or amino-alcohol compound with a molybdenum source, compounds prepared by reacting a fatty oil, mono-alkylated alkylene diamine, and a molybdenum source, compounds prepared by reacting a fatty acid, mono-alkylated alkylene diamine, glycerides, and a molybdenum source.

2. The lubricating composition as described in claim 1, wherein the diarylamine comprises an alkylated diphenylamine.

3. The lubricating composition as described in claim 2, wherein the alkylated diphenylamine has a concentration of about 0.1 to 2.5 wt. % in the lubricating composition.

4. The lubricating composition as described in claim 3, wherein the alkylated diphenylamine has a concentration of about 0.2 to 1.5 wt. % in the lubricating composition.

5. The lubricating composition as described in claim 1, wherein the oil soluble molybdenum compound further comprises sulfur.

6. The lubricating composition as described in claim 1, wherein the oil soluble molybdenum compound has a concentration sufficient to provide about 20 to 1000 ppm of molybdenum in the lubricating composition.

7. The lubricating composition as described in claim 6, wherein the oil soluble molybdenum compound has a concentration sufficient to provide about 20 to 200 ppm of molybdenum in the lubricating composition.

8. The lubricating composition as described in claim 1, wherein the oil soluble alkylated phenothiazine has a concentration of about 0.05 to 1.5 wt. % in the lubricating composition.

9. The lubricating composition as described in claim 8, wherein the oil soluble alkylated phenothiazine has a concentration of about 0.1 to 1.0 wt. % in the lubricating composition.

10. The lubricating composition as described in claim 1, wherein the alkylated phenothiazine is disubstituted, with each substituted alkyl group comprising from four to about twenty-four carbon atoms.

11. The lubricating composition as described in claim 10, wherein each substituted alkyl group on the alkylated phenothiazine comprises four to, but including, eight carbon atoms.

12. The lubricating composition as described in claim 1, wherein the alkylated phenothiazine comprises dioctylphenothiazine.

13. The lubricating composition as described in claim 1, wherein the alkylated phenothiazine comprises monooctylphenothiazine.

14. The lubricating composition as described in claim 1, wherein the alkylated phenothiazine comprises dinonylphenothiazine.

15. The lubricating composition as described in claim 1, wherein the alkylated phenothiazine comprises monononylphenothiazine.

16. The lubricating composition as described in claim 1, wherein the alkylated phenothiazine comprises mono $C_{14}$ alkylphenothiazine.

17. The lubricating composition as described in claim 1, wherein the alkylated phenothiazine comprises di $C_{14}$ alkylphenothiazine.

18. A lubricating composition consisting essentially of a major amount of lubricating oil, an oil soluble molybdenum compound, and an oil soluble $C_{4-24}$ alkylated phenothiazine, wherein said molybdenum compound is selected from the group consisting of molybdenum trioxides, ammonium molybdates, sodium molybdates, potassium molybdates, molybdenum dithiocarbamates, compounds prepared by reacting molybdenum trioxide with a secondary amine and carbon disulfide, compounds prepared by reacting a sulfur-free molybdenum source with a secondary amine, carbon disulfide, and an additional sulfur source, compounds prepared by reacting a molybdenum halide with a secondary amine and carbon disulfide, compounds prepared by reacting a molybdenum source with a basic nitrogen compound and a sulfur source, compounds prepared by reacting ammonium tetrathiomolybdate with a basic nitrogen compound, compounds prepared by reacting an olefin, sulfur, an amine and a molybdenum source, compounds prepared by reacting ammonium tetrathiomolybdate with a basic nitrogen compound and an organic sulfur source, compounds prepared by reacting a phenolic compound, an amine and a molybdenum source with a sulfur source, compounds prepared by reacting a triglyceride, a basic nitrogen compound, a molybdenum source, and a sulfur source, compounds prepared by reacting alkali metal alkylthioxanthate salts with molybdenum halides, compounds prepared by reacting a tetralkylthiuram disulfide with molybdenum hexacarbonyl, compounds prepared by reacting an alkyl dixanthogen with molybdenum hexacarbonyl, compounds prepared by reacting alkali metal alkylxanthate salts with dimolybdenum tetra-acetate, compounds prepared by reacting$(NH_4)_2Mo_3S_{13}{}^*{}_2H_2O$ with an alkali metal dialkyldithiocarbamate or tetraalkyl thiuram disulfide, compounds prepared by reacting an ester or acid with a diamine, a molybdenum source and carbon disulfide, compounds prepared by reacting an alkali metal dialkyldithiocarbamate with 3-chloropronionic acid, followed by molybdenum trioxide, compounds prepared by reacting basic nitrogen compounds with a molybdenum source, compounds prepared by reacting a hydrocarbyl substituted hydroxy alkylated amine with a molybdenum source, compounds prepared by reacting a phenol aldehyde condensation product, a mono-alkylated alkylene diamine, and a molybdenum source, compounds prepared by reacting a fatty oil, diethanolamine, and a molybdenum source, compounds prepared by reacting a fatty oil or acid with 2-(2-aminoethyl)aminoethanol, and a molybdenum source, compounds prepared by reacting a secondary amine with a molybdenum source, compounds prepared by reacting a diol, diamino, or amino-alcohol compound with a molybdenum source, compounds prepared by reacting a fatty oil, mono-alkylated alkylene diamine, and a molybdenum source, compounds prepared by reacting a fatty acid, mono-alkylated alkylene diamine, glycerides, and a molybdenum source.

19. The lubricating composition as described in claim 18, wherein the oil soluble molybdenum compound further comprises sulfur.

20. The lubricating composition as described in claim 18, wherein the oil soluble molybdenum compound has a concentration sufficient to provide about 20 to about 1000 ppm of molybdenum in the lubricating composition.

21. The lubricating composition as described in claim 20, wherein the oil soluble molybdenum compound has a concentration sufficient to provide about 20 to about 200 ppm of molybdenum in the lubricating composition.

22. The lubricating composition as described in claim 18, wherein the oil soluble alkylated phenothiazine has a concentration of about 0.05 to 1.5 wt. % in the lubricating composition.

23. A lubricating composition as described in claim 22, wherein the oil soluble alkylated phenothiazine has a concentration of about 0.1 to 1.0 wt. % in the lubricating composition.

24. A lubricating composition as described in claim 18, wherein at least one of the alkyl groups of the alkylated phenothiazine comprises from four to about twenty-four carbon atoms.

25. The lubricating composition as described in claim 18, wherein the alkylated phenothiazine is disubstituted, with each substituted alkyl group comprising from about four to about twenty-four carbon atoms.

26. The lubricating composition as described in claim 18, wherein each substituted alkyl group has four to, but including, eight carbon atoms.

27. A lubricating composition as described in claim 18, wherein the alkylated phenothiazine comprises dioctylphenothiazine.

28. The lubricating composition as described in claim 18, wherein the alkylated phenothiazine comprises monooctylphenothiazine.

29. The lubricating composition as described in claim 18, wherein the alkylated phenothiazine comprises dinonylphenothiazine.

30. The lubricating composition as described in claim 18, wherein the alkylated phenothiazine comprises monononylphenothiazine.

31. The lubricating composition as described in claim 18, wherein the alkylated phenothiazine comprises mono $C_{14}$ alkylphenothiazine.

32. The lubricating composition as described in claim 18, wherein the alkylated phenothiazine comprises di $C_{14}$ alkylphenothiazine.

33. A lubricating composition additive consisting essentially of an oil soluble secondary diarylamine, an oil soluble molybdenum compound, and an oil soluble alkylated $C_{4-24}$ phenothiazine, wherein said molybdenum compound is selected from the group consisting of molybdenum trioxides, ammonium molybdates, sodium molybdates, potassium molybdates, molybdenum dithiocarbamates, compounds prepared by reacting molybdenum trioxide with a secondary amine and carbon disulfide, compounds prepared by reacting a sulfur-free molybdenum source with a secondary amine, carbon disulfide, and an additional sulfur source, compounds prepared by reacting a molybdenum halide with a secondary amine and carbon disulfide, compounds prepared by reacting a molybdenum source with a basic nitrogen compound and a sulfur source, compounds prepared by reacting ammonium tetrathiomolybdate with a basic nitrogen compound, compounds prepared by reacting an olefin, sulfur, an amine and a molybdenum source, compounds prepared by reacting ammonium tetrathiomolybdate with a basic nitrogen compound and an organic sulfur source, compounds prepared by reacting a phenolic compound, an amine and a molybdenum source with a sulfur source, compounds prepared by reacting a triglyceride, a basic nitrogen compound, a molybdenum source, and a sulfur source, compounds prepared by reacting alkali metal alkylthioxanthate salts with molybdenum halides, compounds prepared by reacting a tetralkylthiuram disulfide with molybdenum hexacarbonyl, compounds prepared by reacting an alkyl dixanthogen with molybdenum hexacarbonyl, compounds prepared by reacting alkali metal alkylxanthate salts with dimolybdenum tetra-acetate, compounds prepared by reacting $(NH_4)_2Mo_3S_{13}*_2H_2O$ with an alkali metal dialkyldithiocarbamate or tetraalkyl thiuram disulfide, compounds prepared by reacting an ester or acid with a diamine, a molybdenum source and carbon disulfide, compounds prepared by reacting an alkali metal dialkyldithiocarbamate with 3-chloropropionic acid, followed by molybdenum trioxide, compounds prepared by reacting basic nitrogen compounds with a molybdenum source, compounds prepared by reacting a hydrocarbyl substituted hydroxy alkylated amine with a molybdenum source, compounds prepared by reacting a phenol aldehyde condensation product, a mono-alkylated alkylene diamine, and a molybdenum source, compounds prepared by reacting a fatty oil, diethanolamine, and a molybdenum source, compounds prepared by reacting a fatty oil or acid with 2-(2-aminoethyl) aminoethanol, and a molybdenum source, compounds prepared by reacting a secondary amine with a molybdenum source, compounds prepared by reacting a diol, diamino, or amino-alcohol compound with a molybdenum source, compounds prepared by reacting a fatty oil, mono-alkylated alkylene diamine, and a molybdenum source, compounds prepared by reacting a fatty acid, mono-alkylated alkylene diamine, glycerides, and a molybdenum source.

34. The lubricating composition additive as described in claim 33, wherein the diarylamine is an alkylated diphenylamine.

35. The lubricating composition additive as described in claim 33, wherein the oil soluble molybdenum compound further comprises sulfur.

36. A lubricating composition additive as described in claim 33, wherein the oil soluble molybdenum compound has a concentration sufficient to provide about 20 to 1000 ppm of molybdenum in the lubricating composition.

37. The lubricating composition additive as described in claim 33, wherein the oil soluble molybdenum compound has a concentration sufficient to provide about 20 to 200 ppm of molybdenum in the lubricating composition.

38. A lubricating composition additive as described in claim 33, wherein at least one of the alkyl groups of the alkylated phenothiazine comprises from four to about twenty-four carbon atoms.

39. The lubricating composition additive as described in claim 33, wherein the alkylated phenothiazine is disubstituted, with each substituted alkyl group comprising from about four to about twenty-four carbon atoms.

40. The lubricating composition additive as described in claim 39, wherein each substituted alkyl group comprises four to, but including, eight carbon atoms.

41. The lubricating composition additive as described in claim 33, wherein the alkylated phenothiazine comprises dioctylphenothiazine.

42. The lubricating composition additive as described in claim 33, wherein the alkylated phenothiazine comprises monooctylphenothiazine.

43. The lubricating composition additive as described in claim 33, wherein the alkylated phenothiazine comprises dinonylphenothiazine.

44. The lubricating composition additive as described in claim 33, wherein the alkylated phenothiazine comprises monononylphenothiazine.

45. The lubricating composition additive as described in claim 33, wherein the alkylated phenothiazine comprises mono $C_{14}$ alkylphenothiazine.

46. The lubricating composition additive as described in claim 33, wherein the alkylated phenothiazine comprises di $C_{14}$ alkylphenothiazine.

47. A lubricating composition additive consisting essentially of an oil soluble molybdenum compound and an oil soluble alkylated $C_{4-24}$ phenothiazine, wherein said molybdenum compound is selected from the group consisting of molybdenum trioxides, ammonium molybdates, sodium molybdates, potassium molybdates, molybdenum dithiocarbamates, compounds prepared by reacting molybdenum trioxide with a secondary amine and carbon disulfide, compounds prepared by reacting a sulfur-free molybdenum source with a secondary amine, carbon disulfide, and an additional sulfur source, compounds prepared by reacting a molybdenum halide with a secondary amine and carbon disulfide, compounds prepared by reacting a molybdenum source with a basic nitrogen compound and a sulfur source, compounds prepared by reacting ammonium tetrathiomolybdate with a basic nitrogen compound, compounds prepared by reacting an olefin, sulfur, an amine and a molybdenum source, compounds prepared by reacting ammonium tetrathiomolybdate with a basic nitrogen compound and an organic sulfur source, compounds prepared by reacting a phenolic compound, an amine and a molybdenum source with a sulfur source, compounds prepared by reacting a triglyceride, a basic nitrogen compound, a molybdenum source, and a sulfur source, compounds prepared by reacting alkali metal alkylthioxanthate salts with molybdenum halides, compounds prepared by reacting a tetralkylthiuram disulfide with molybdenum hexacarbonyl, compounds prepared by reacting an alkyl dixanthogen with molybdenum hexacarbonyl, compounds prepared by reacting alkali metal alkylxanthate salts with dimolybdenum tetra-acetate, compounds prepared by reacting $(NH_4)_2Mo_3S_{13}*_2H_2O$ with an alkali metal dialkyldithiocarbamate or tetraalkyl thiuram disulfide, compounds prepared by reacting an ester or acid with a diamine, a molybdenum source and carbon disulfide, compounds prepared by reacting an alkali metal dialkyldithiocarbamate with 3-chloropropionic acid, followed by molybdenum trioxide, compounds prepared by reacting basic nitrogen compounds with a molybdenum source, compounds prepared by reacting a hydrocarbyl substituted hydroxy alkylated amine with a molybdenum source, compounds prepared by reacting a phenol aldehyde condensation product, a mono-alkylated alkylene diamine, and a molybdenum source, compounds prepared by reacting a fatty oil, diethanolamine, and a molybdenum source, compounds prepared by reacting a fatty oil or acid with 2-(2-aminoethyl)aminoethanol and a molybdenum source, compounds prepared by reacting a secondary amine with a molybdenum source, compounds prepared by reacting a diol, diamino, or amino-alcohol compound with a molybdenum source, compounds prepared by reacting a fatty oil, mono-alkylated alkylene diamine, and a molybdenum source, compounds prepared by reacting a fatty acid, mono-alkylated alkylene diamine, glycerides, and a molybdenum source.

48. The lubricating composition additive as described in claim 47, wherein the oil soluble molybdenum compound further comprises sulfur.

49. The lubricating composition additive as described in claim 47, wherein at least one of the alkyl groups of the alkylated phenothiazine comprises from four to about twenty-four carbon atoms.

50. The lubricating composition additive as described in claim 47, wherein the alkylated phenothiazine is disubstituted, with each substituted alkyl group comprising from about four to about twenty-four carbon atoms.

51. The lubricating composition additive as described in claim 50, wherein each substituted alkyl group comprises four to, but including, eight carbon atoms.

52. The lubricating composition additive as described in claim 47, wherein the alkylated phenothiazine comprises dioctylphenothiazine.

53. The lubricating composition additive as described in claim 47, wherein the alkylated phenothiazine comprises monoctylphenothiazine.

54. The lubricating composition additive as described in claim 47, wherein the alkylated phenothiazine comprises dinonylphenothiazine.

55. The lubricating composition additive as described in claim 47, wherein the alkylated phenothiazine comprises monononylphenothiazine.

56. The lubricating composition additive as described in claim 47, wherein the alkylated phenothiazine comprises mono $C_{14}$ alkylphenothiazine.

57. The lubricating composition additive as described in claim 47, wherein the alkylated phenothiazine comprises di $C_{14}$ alkylphenothiazine.

58. A method for improving the antioxidancy and/or anti-Wear properties of a lubricating composition comprising including in the lubricating composition an oil soluble molybdenum compound and an oil soluble alkylated $C_4$–$C_{24}$ phenothiazine.

59. The method as described in claim 58, further comprising including in the lubricating composition an oil soluble secondary diarylamine.

60. The method as described in claim 59, wherein the diarylamine is an alkylated diphenylamine.

61. The method as described in claim 59, wherein the secondary diarylamine has a concentration of about 0.1 to 2.5 wt. % in the lubricating composition.

62. The method as described in claim 59, wherein the secondary diarylamine has a concentration of about 0.2 to 1.5 wt. % in the lubricating composition.

63. The method as described in claim 58, wherein the oil soluble molybdenum compound further comprises sulfur.

64. The method as described in claim 58, wherein the oil soluble molybdenum compound has a concentration sufficient to provide about 20 to about 1000 ppm of molybdenum in the lubricating composition.

65. The method as described in claim 64, wherein the oil soluble molybdenum compound has a concentration sufficient to provide about 20 to 200 ppm of molybdenum in the lubricating composition.

66. The method as described in claim 58, wherein the oil soluble alkylated phenothiazine has a concentration of about 0.05 to 1.5 wt. % in the lubricating composition.

67. The method as described in claim 66, wherein the oil soluble alkylated phenothiazine has a concentration of about 0.1 to 1.0 wt. % in the lubricating composition.

68. The method as described in claim 58, wherein at least one of the alkyl groups of the alkylated phenothiazine comprises from four about twenty-four carbon atoms.

69. The method as described in claim 58, wherein the alkylated phenothiazine is disubstituted, with each substituted alkyl group comprising from about four to about twenty-four carbon atoms.

70. The method as described in claim 69, wherein each substituted alkyl group has four to but including eight carbon atoms.

71. The method as described in claim 58, wherein the alkylated phenothiazine comprises dioctylphenothiazine.

72. The method as described in claim 58, wherein the alkylated phenothiazine comprises monooctylphenothiazine.

73. The method as described in claim 58, wherein the alkylated phenothiazine comprises dinonylphenothiazine.

74. The method as described in claim 58, wherein the alkylated phenothiazine comprises monononylphenothiazine.

75. The method as described in claim 58, wherein the alkylated phenothiazine comprises mono $C_{14}$ alkylphenothiazine.

76. The method as described in claim 58, wherein the alkylated phenothiazine comprises di $C_{14}$ alkylphenothiazine.

77. The method as described in claim 58, further comprising including in the lubricating composition an oil soluble alkylated diphenylamine, an oil soluble phosphorus compound, and an oil soluble hindered phenolic derived from 2,6-di-tert-butyiphenol.

78. The method as described in claim 58, further comprising including in the lubricating composition an oil soluble alkylated diphenylamine, an oil soluble phosphorus compound, and an oil soluble calcium-containing detergent.

79. A method for lubricating an engine, comprising lubricating said engine with a lubricating composition of claim 1.

80. A method for lubricating an engine, comprising lubricating said engine with a lubricating composition of claim 18.

81. A method for lubricating an engine, comprising lubricating said engine with a lubricant containing the lubricant composition additive of claim 33.

82. A method for lubricating an engine, comprising lubricating said engine with a lubricant containing the lubricant composition additive of claim 47.

83. The composition of claim 1, wherein the composition comprises zero phosphorus.

84. The composition of claim 1, wherein the composition comprises essentially zero phosphorus.

85. The composition of claim 18, wherein the composition comprises zero phosphorus.

86. The composition of claim 18, wherein the composition comprises essentially zero phosphorus.

87. The composition of claim 33, wherein the composition comprises zero phosphorus.

88. The composition of claim 33, wherein the composition comprises essentially zero phosphorus.

* * * * *